US005183367A

United States Patent [19]

Namur

[11] Patent Number: 5,183,367

[45] Date of Patent: Feb. 2, 1993

[54] DAGGER BOARD STORAGE HOUSING FOR SAILBOARDS

[76] Inventor: Marc Namur, IM Harras, 10, D-6100 Darmstadt, Fed. Rep. of Germany

[21] Appl. No.: 753,662

[22] Filed: Sep. 3, 1991

[30] Foreign Application Priority Data

Sep. 4, 1990 [DE] Fed. Rep. of Germany ..... 4028033
Sep. 17, 1990 [DE] Fed. Rep. of Germany ..... 4029422

[51] Int. Cl.[5] ..... B63B 35/79
[52] U.S. Cl. ..... 441/79; 114/132
[58] Field of Search ..... 441/79; 114/39.2, 130, 114/132, 138, 140, 141

[56] References Cited

U.S. PATENT DOCUMENTS 3,087,173 4/1963 Meyer ..... 114/132 X
4,721,051 1/1988 Willard ..... 114/141

FOREIGN PATENT DOCUMENTS 2801738 8/1979 Fed. Rep. of Germany .
3038938 5/1982 Fed. Rep. of Germany ..... 114/132
3438116 4/1986 Fed. Rep. of Germany ..... 114/132
3217444 6/1987 Fed. Rep. of Germany .
3741067 8/1988 Fed. Rep. of Germany ..... 441/79
162190 6/1990 Japan ..... 114/132

*Primary Examiner*—Sherman Basinger
*Attorney, Agent, or Firm*—Young & Thompson

[57] ABSTRACT

A dagger board bearing for sailboards, developed with the objective of improving sailing properties, exhibits a dagger board casing (4) inserted in a sailboard (1) wherein a dagger board (5) introducible from above is pivotably supported with a first handle (6) projecting beyond the topside of the board (5). An external pivot pin (12) in the zone of the top edge (13) of the dagger board (5) and an internal pivot pin (14), offset with respect to the external pivot pin (12) are molded to a top section (11) of the dagger board (5). The pivot pins (12, 14) are arranged on one side of the top section (11) of the dagger board (5) with a mutual first spacing (a) in the longitudinal direction of the dagger board (5) and with a mutual second spacing (b) in the transverse direction of the dagger board (5). An exchangeable insert panel (17) with two guide and bearing grooves (18, 19), fashioned in a curved shape for receiving the pivot pins (12, 14), can be inserted in a sidewall (16) of the dagger board casing (4), guide rollers (15) being mounted on these pivot pins (12, 14). The two-point pivot bearing permits, as compared with conventional dagger board bearings, a displacement of the first handle (6) into a position (6a) shifted in the direction of the stern, with the dagger board (5) being swung inwards, thus causing a corresponding displacement of a rearmost position of a mast foot (10) in the stern direction. In this way, the velocity of the sailboard (1) in case of off-wind sailing courses is increased.

2 Claims, 2 Drawing Sheets

DAGGER BOARD STORAGE HOUSING FOR SAILBOARDS

BACKGROUND

1. Field of the Invention

The invention relates to a dagger board bearing for sailboards, with a dagger board casing inserted in the sailboard wherein a dagger board introducible from above and having a handle projecting past the topside of the sailboard is pivotably supported.

2. Description of the Related Art

In a dagger board bearing of this type known from German Patent No. 3,217,444, the dagger board is swung, during the outward and inward pivoting, about two pivot pins arranged on both sides of the dagger board and having a common fulcrum; these pivot pins are seated in guide and bearing grooves in the sidewalls of the bottom section of a bipartite dagger board casing. The relatively large pivoting range, necessary due to the monoaxial pivot bearing of the dagger board, of the handle of the dagger board, projecting past the topside of the sailboard, the outwardly pivoted position of which is predetermined by the size of the sailboard, has the result that the handle, with the dagger board swung inwards, occupies a position that is advanced to a comparatively far extent in the direction of the bow. On account of the forward-shifted position of the dagger board handle, the rearmost position of the mast foot is limited, the latter being adjustable in the longitudinal direction of the board by means of a slide displaceable in a mast rail. The restriction of the rearmost mast foot position by the relatively far-advanced position of the dagger board handle in the bow direction, with the dagger board being swung inwards, has a negative effect on the velocity of the sailboard on off-wind sailing courses.

SUMMARY OF THE INVENTION

The invention is based on the object of reducing the pivoting range of the dagger board handle in a dagger board of the type under consideration, during the outward and inward pivoting of the dagger board.

This object has been attained by a dagger board bearing exhibiting the features of the present invention.

Suitable further developments of the dagger board bearing can be derived from the accompanying detailed description.

The dagger board bearing according to this invention brings about a considerable improvement in the sailing properties of a sailboard without impairing the handling of the dagger board with a reduced pivoting range of the dagger board handle, as compared with the conventional sailboards. The invariably good handling of the dagger board is attained by the dual support provided for the novel dagger board, ensuring favorable lever relationships especially during the outward unfolding of the dagger board so that the operating forces to be expended by the windsurfer during the outward unfolding of the dagger board due to friction of the sealing lips against the underside of the dagger board casing can be controlled without difficulties by adults and juveniles alike. Finally, the velocity of, in particular, racing sailboards can be increased by the installation of an appropriate insert panel with the guide and bearing grooves for the pivot pins of the dagger board, permitting optimum displacement of the rearmost position of the mast foot in the stern direction.

BRIEF DESCRIPTION OF THE DRAWINGS

The invention will be described in greater detail below with reference to the drawings wherein.

DETAILED DESCRIPTION OF THE PREFERRED EMBODIMENT

Figure 1:
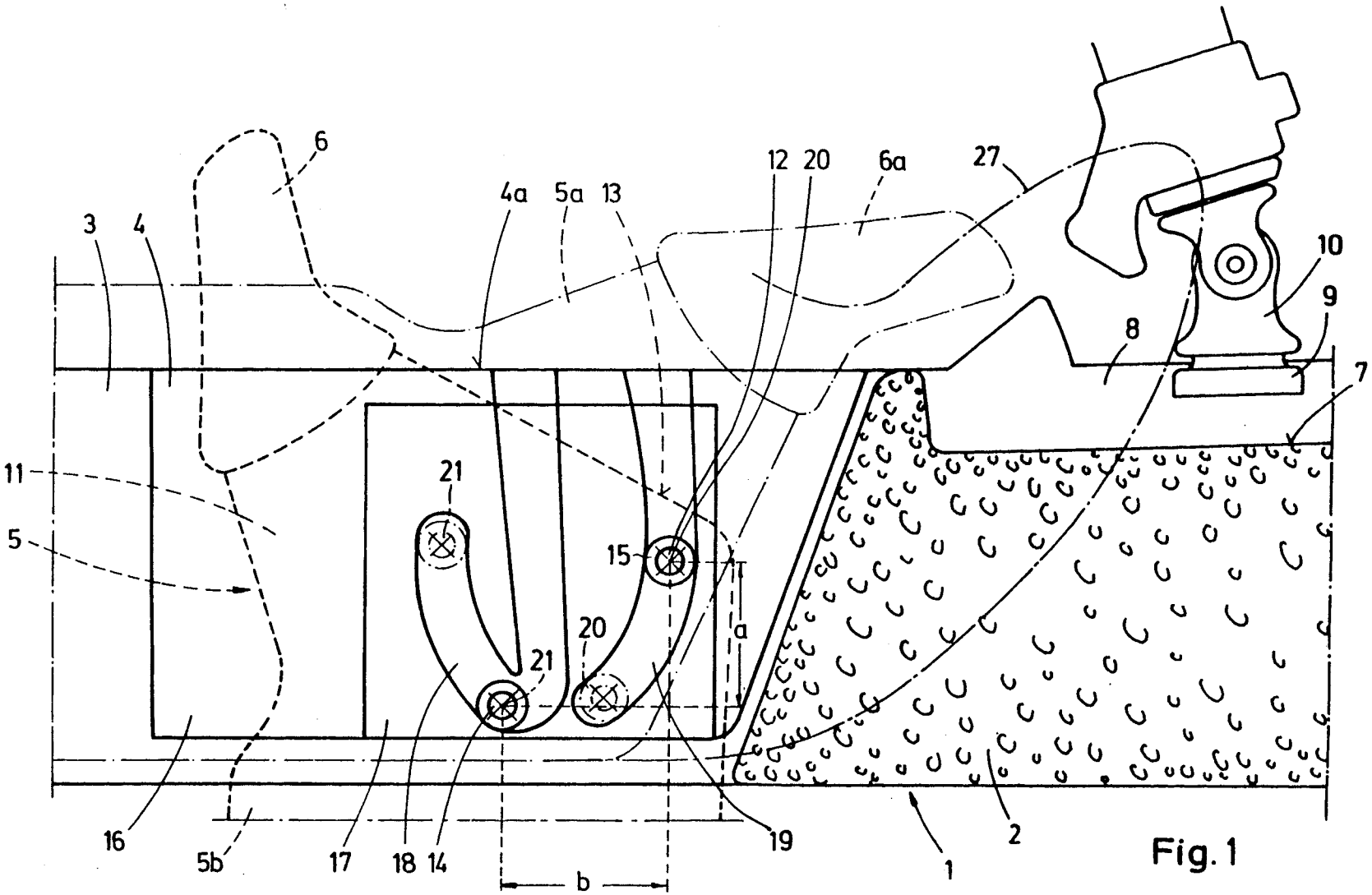
FIG. 1 shows a longitudinal sectional view of the novel dagger board bearing.

A sailboard 1 with a core 2 of foam material is provided with a recess 3 in the core accommodating a dagger board casing 4 injection-molded of a synthetic resin; this recess 3 is extended in the direction of the stern for receiving a swung-in dagger board 5. The dagger board 5, made of a synthetic resin and provided with a first handle 6, can be inserted in the dagger board casing 4 from above.

A mast rail 8 with a slide 9, displaceable in the longitudinal direction of the board 5 in order to set varying positions of a mast foot 10, is inserted in a further recess 7 of the core 2 in front of the dagger board casing 4.

An external pivot pin 12 in the region of the top edge 13 of the dagger board 5 and an internal pivot pin 14, offset with respect to the first-mentioned pin 12, are integrally molded at a dagger board top section 11; these pins 12 and 14 are arranged in the longitudinal direction of the dagger board 5 with a first spacing a and in the transverse direction of the dagger board 5 with a second spacing b from each other on one side of the dagger board top section 11. Synthetic resin rollers 15 are mounted on the pivot pins 12, 14.

An exchangeable insert panel 17 of a synthetic resin is inserted from below in a sidewall 16 of the dagger board casing 4 with a corresponding recess; this insert panel 17 locks together with the sidewall 16. The insert panel 17 exhibits two guide and bearing grooves 18, 19, fashioned in the manner of a curve, for receiving the pivot pins 12, 14 of the dagger board 5 with the rollers 15. The bearing grooves 18, 19 extend up to a topside **4*a* of the dagger board casing 4**.

Figure 2:
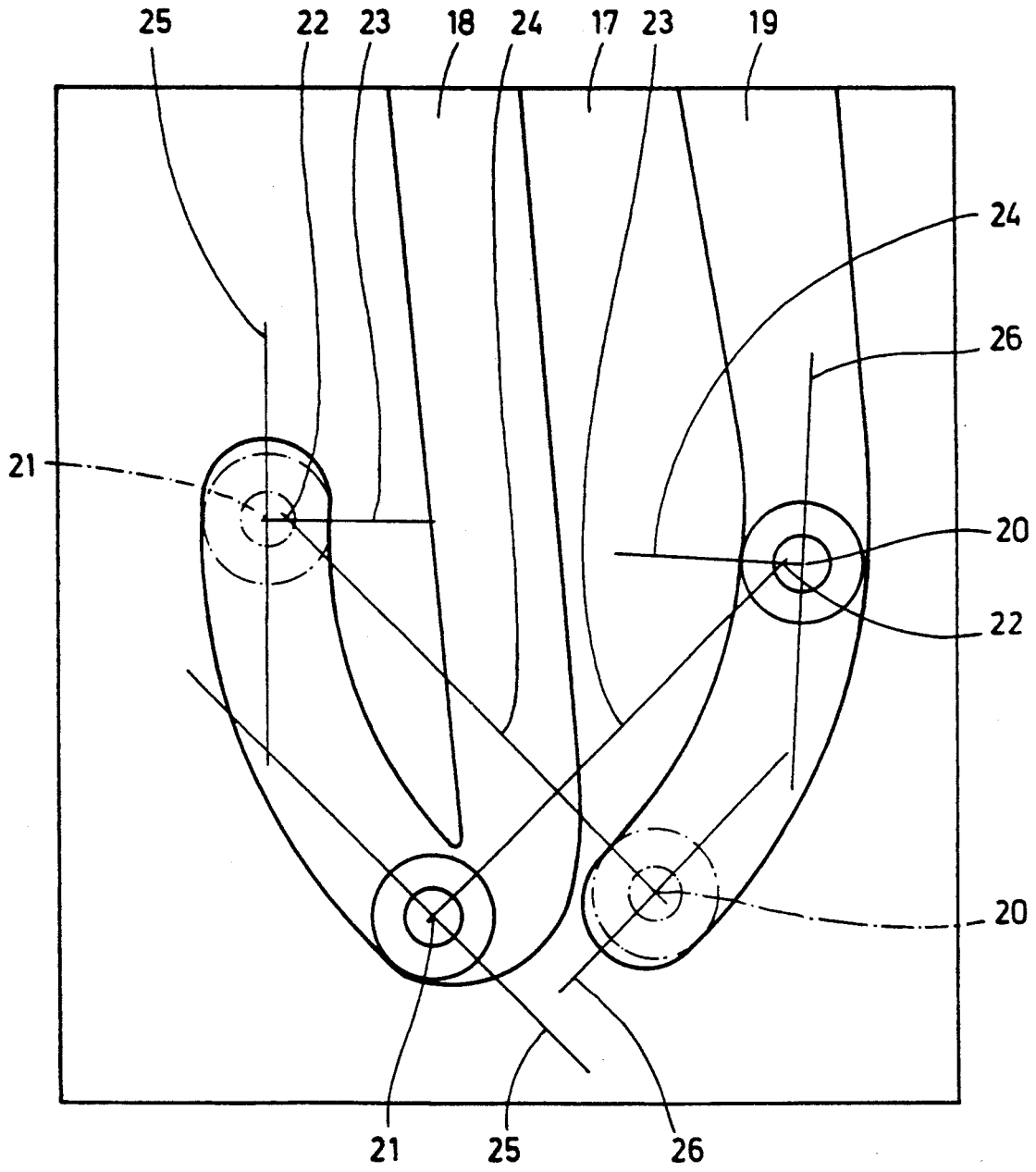
FIG. 2 shows the kinematics of the dagger board bearing.

The kinematics of the dagger board bearing illustrated in FIG. 2 are as follows:

Upon the outward pivoting of the dagger board 5 from a first position **5*a* into a second position 5*b* (both shown in FIG. 1) and the inward pivoting of the dagger board 5 in the reverse direction, the two pivot pins 12, 14 constitute two variable fulcrums 20, 21, and the dagger board 5 swings about a variable, imaginary fulcrum 22 resulting from the point of intersection of two normals 23, 24 with two tangents, 25, 26 in the guide and bearing grooves 18, 19 at the variable fulcrums 20, 21 for the respective position of the dagger board 5**.

The position, shown in dot-dash lines in FIG. 1, of a second handle 27 pertaining to a conventional, inwardly swung dagger board 5 with a single-point pivot bearing, clarifies a position **6*a* of the first handle 6 of the inwardly swung dagger board 5**, displaced in the stern direction, which position is attainable by the two-point pivot bearing arrangement.

I claim:

1. Dagger board bearing for sailboards, with a dagger board casing (4) inserted in a sailboard (1), wherein a dagger board (5) introductible from above and having a first handle (6) projecting past a topside (**4*a*) of the sailboard (1) is pivotally supported, characterized by an external pivot pin (12) in the zone of a top edge (13) of the dagger board (5), arranged at a top section (11) of the dagger board (5), and by an internal pivot pin (14) offset with respect to the external pivot pin (12), these pivot pins (12, 14) being molded onto one side of the top section (11) of the dagger board (5) with a mutual first spacing (a) in the longitudinal direction of the dagger board (5) and with a mutual second spacing (b) in the transverse direction of the dagger board (5), as well as by two guide and bearing grooves (18, 19) to accommodate the pivot pins (12, 14) arranged in a sidewall (16) of the dagger board casing (4) and designed to be of a curved shape, these bearing grooves (18, 19) extending in the vertical direction of the dagger board casing (4) up to the topside (4***a*) of the sailboard (1) in such a manner that, during the outward and inward pivoting of the dagger board (5), the two pivot pins (12, 14) form two variable fulcrums (20, 21), and the dagger board (5) pivots about a variable, imaginary fulcrum (22) resulting from the point of intersection of two normals (23, 24) with two tangents (25, 26) in the guide and bearing grooves (18, 19) at the variable fulcrums (20, 21) for respective positions of the dagger board (5) during the outward and inward pivoting thereof.

2. Dagger board bearing according to claim 1, characterized by rollers (15) being placed onto the pivot pins (12, 14) of the dagger board (5) and travelling in the two guide and bearing grooves (18, 19) of the dagger board casing (4).

* * * * *